US006135367A

United States Patent [19]

Hsu

[11] Patent Number: 6,135,367

[45] Date of Patent: Oct. 24, 2000

[54] ATOMIZING BOARDS WITH ASYMMETRICALLY DISTRIBUTED ATOMIZING HOLES

[76] Inventor: Tsung-Ming Hsu, No. 18, Jen Ping Lane Feng Jen Rd., Jen Wu Hsian, Kaohsiung Hsien, Taiwan

[21] Appl. No.: 09/146,238

[22] Filed: Sep. 3, 1998

[51] Int. Cl.[7] ..... B05B 1/14

[52] U.S. Cl. ..... 239/553.5; 239/555; 239/556; 239/590.5; 126/299 D; 126/299 E; 55/440; 55/442

[58] Field of Search ..... 239/553, 553.5, 239/555, 556, 590.5; 55/440, 441, 442, 446; 126/299 D, 299 E; 261/78.1, 78.2, 113; 128/204.13

[56] References Cited

U.S. PATENT DOCUMENTS 5,601,072 2/1997 Hsu ..... 126/299 E

FOREIGN PATENT DOCUMENTS 293481 12/1996 Taiwan .

*Primary Examiner*—David J. Walczak
*Assistant Examiner*—Timothy L. Maust
*Attorney, Agent, or Firm*—Bacon & Thomas

[57] ABSTRACT

An atomizing board includes a board surrounded by a peripheral frame that is configured to allow stacking of two atomizing boards. The board includes a number of atomizing holes defined therein. A periphery that defines each atomizing hole includes an annular upper wall extending upwardly therefrom and an annular lower wall extending downwardly therefrom. The atomizing holes are arranged in the board in a manner that they are asymmetrical to a central transverse axis of the board such that in two stacked atomizing boards consisting of an upper atomizing board and a lower atomizing board, one of the lower atomizing board and the upper atomizing board is in a status that is rotated through 180° or turned upside-down relative to the other of the lower atomizing board and the upper atomizing board, and each atomizing hole on the upper atomizing board is partially aligned with at least one of the atomizing holes of the lower atomizing board.

7 Claims, 7 Drawing Sheets

ATOMIZING BOARDS WITH ASYMMETRICALLY DISTRIBUTED ATOMIZING HOLES

BACKGROUND OF THE INVENTION

1. Field of the Invention

The present invention relates to improved atomizing boards with asymmetrically distributed atomizing holes for effectively atomizing liquids.

2. Description of the Related Art

Taiwan Utility Model Publication No. 293481 discloses atomizing boards that can be stacked. The atomizing board includes a number of spaced clockwise guiding holes and counterclockwise guiding holes. When two atomizing boards are stacked, each clockwise guiding hole of the upper atomizing board is aligned with a counterclockwise guiding hole of the lower atomizing board, while each counterclockwise guiding hole of the upper atomizing board is aligned with a clockwise guiding hole of the lower atomizing board. In addition, each clockwise guiding hole includes clockwise blades therein, and each counterclockwise guiding hole includes counterclockwise blades therein. This results in a complicated structure, and the molds therefor are also complicated and expensive. The present invention is intended to provide an improved atomizing board to solve this problem.

SUMMARY OF THE INVENTION

It is a primary object of the present invention to provide a simplified atomizing board to atomize liquid so as to be mixed with gas.

In accordance with an embodiment of the invention, an atomizing board comprises a board surrounded by a peripheral frame that is configured to allow stacking of two atomizing boards. The board includes a plurality of atomizing holes defined therein. A periphery that defines each atomizing hole includes an annular upper wall extending upwardly therefrom and an annular lower wall extending downwardly therefrom, the annular upper wall including a plurality of notches defined therein.

The atomizing holes are arranged in the board in a manner that they are asymmetrical to a central transverse axis of the board such that in two stacked atomizing boards consisting of an upper atomizing board and a lower atomizing board, one of the lower atomizing board and the upper atomizing board is in a status that is rotated through 180° or turned upside-down relative to the other of the lower atomizing board and the upper atomizing board, and each atomizing hole on the upper atomizing board is partially aligned with at least one of the atomizing holes of the lower atomizing board.

Each notch has a lower edge that is flush with or slightly greater than the board.

In another embodiment of the invention, an atomizing board comprises a board surrounded by a peripheral frame that is configured to allow stacking of two atomizing boards. The board includes a plurality of clockwise atomizing holes and a plurality of counterclockwise atomizing holes defined therein. Each clockwise atomizing hole includes a plurality of clockwise oriented blades therein, and each counterclockwise atomizing hole includes a plurality of counterclockwise oriented blades therein. A periphery that defines each of the clockwise atomizing holes and the counterclockwise atomizing holes includes an annular upper wall extending upwardly therefrom and an annular lower wall extending downwardly therefrom, the annular upper wall including a plurality of notches defined therein.

The clockwise atomizing holes and the counterclockwise atomizing holes are arranged on both sides of a central transverse axis of the board, respectively, such that in two stacked atomizing boards consisting of an upper atomizing board and a lower atomizing board, one of the lower atomizing board and the upper atomizing board is in a status that is rotated through 180° relative to the other of the lower atomizing board and the upper atomizing board, each clockwise atomizing hole on the upper atomizing board is partially aligned with at least one of the counterclockwise atomizing holes of the lower atomizing board, and each counterclockwise atomizing hole on the upper atomizing board is partially aligned with at least one of the clockwise atomizing holes of the lower atomizing board.

The annular lower wall of each of the clockwise atomizing holes and the counterclockwise atomizing holes includes a plurality of gas inlets. Each of the clockwise oriented blades and the counterclockwise oriented blades includes a relatively longer arcuate portion having a root, and each gas inlet is located adjacent to the root of the arcuate portion of an associated one of the clockwise oriented blades and the counterclockwise oriented blades.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
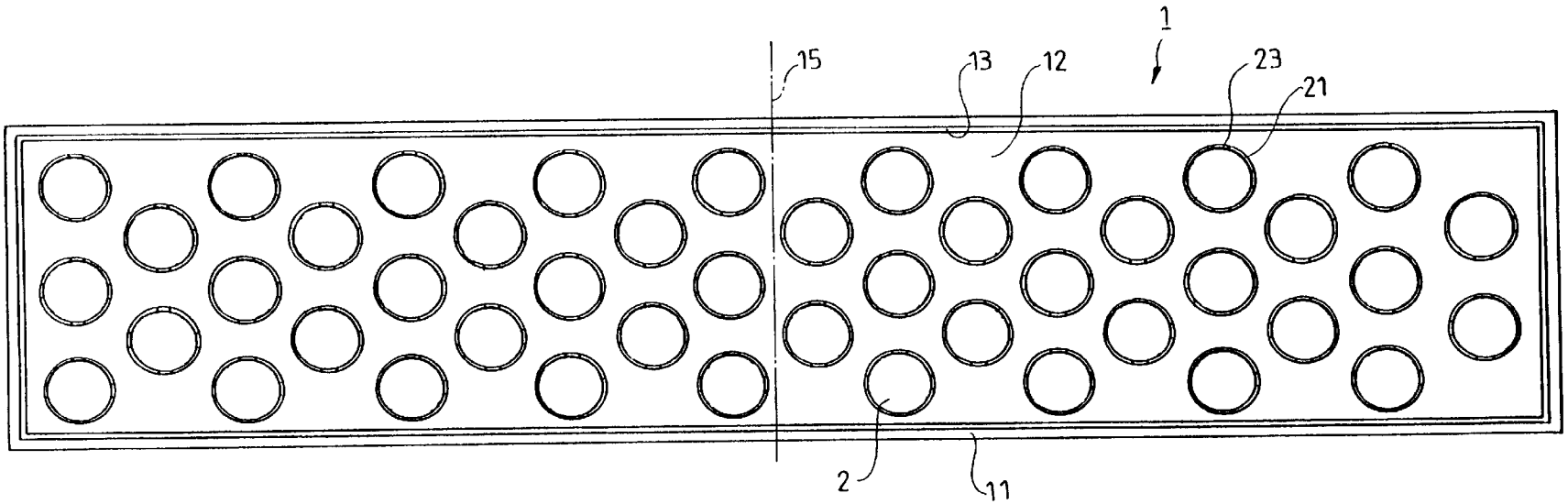
FIG. 1 is a top view of an atomizing board in accordance with the present invention.
Figure 2:
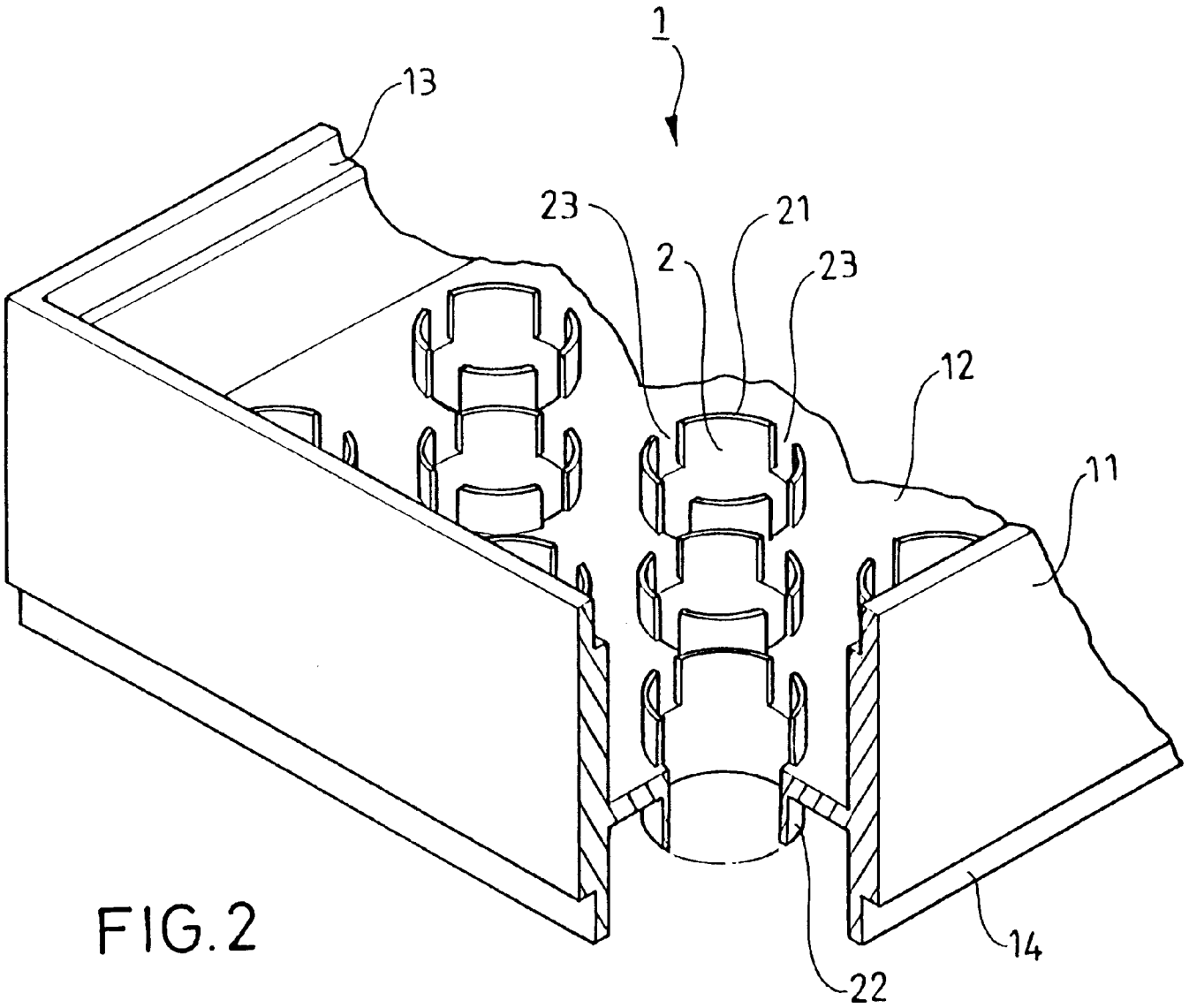
FIG. 2 is a partial perspective view, partly cutaway, of the atomizing board in accordance with the present invention.

Referring to the drawings and initially to FIGS. 1 and 2, an atomizing board 1 in accordance with the present invention is preferably polygonal (e.g., rectangular) and includes a board 12 surrounded by a peripheral wall 11 and a plurality of atomizing holes 2 defined in the board 12. The peripheral wall 11 includes a peripheral ledge 13 formed on an upper part thereof and a recessed peripheral section 14 to allow stacking of two atomizing boards 1.

Figure 3:
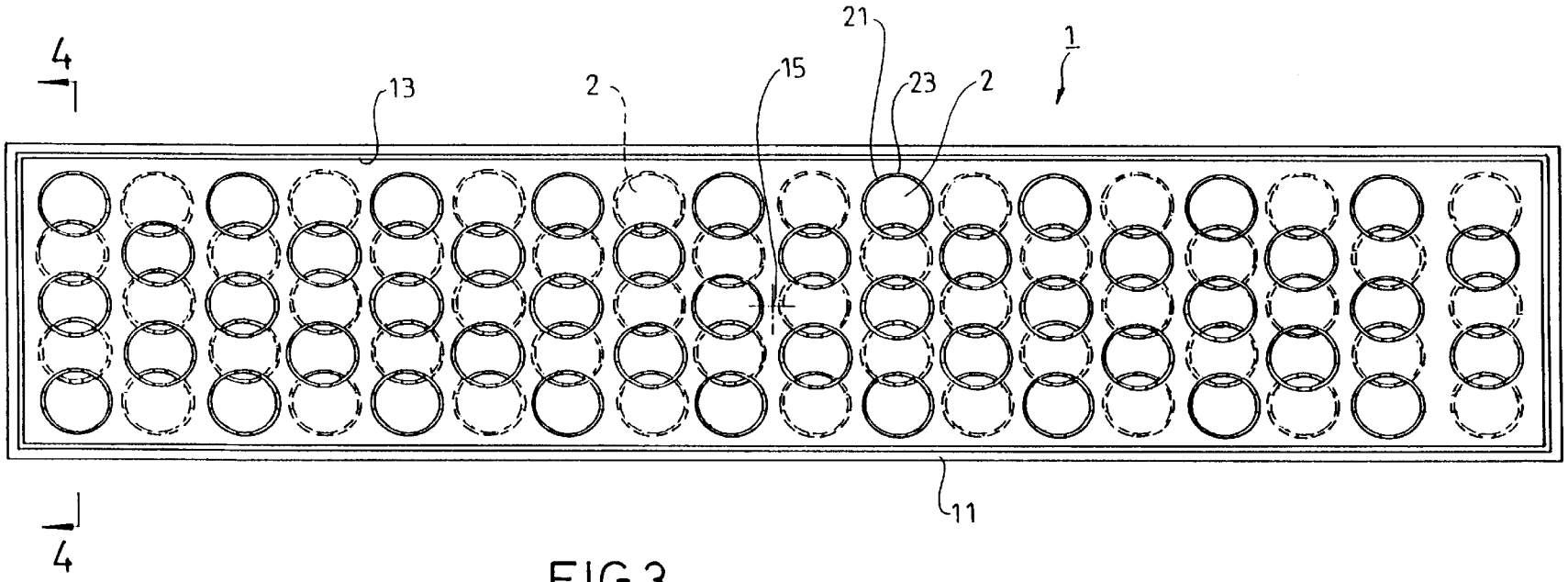
FIG. 3 is a top view of two stacked atomizing boards in accordance with the present invention.
Figure 4:
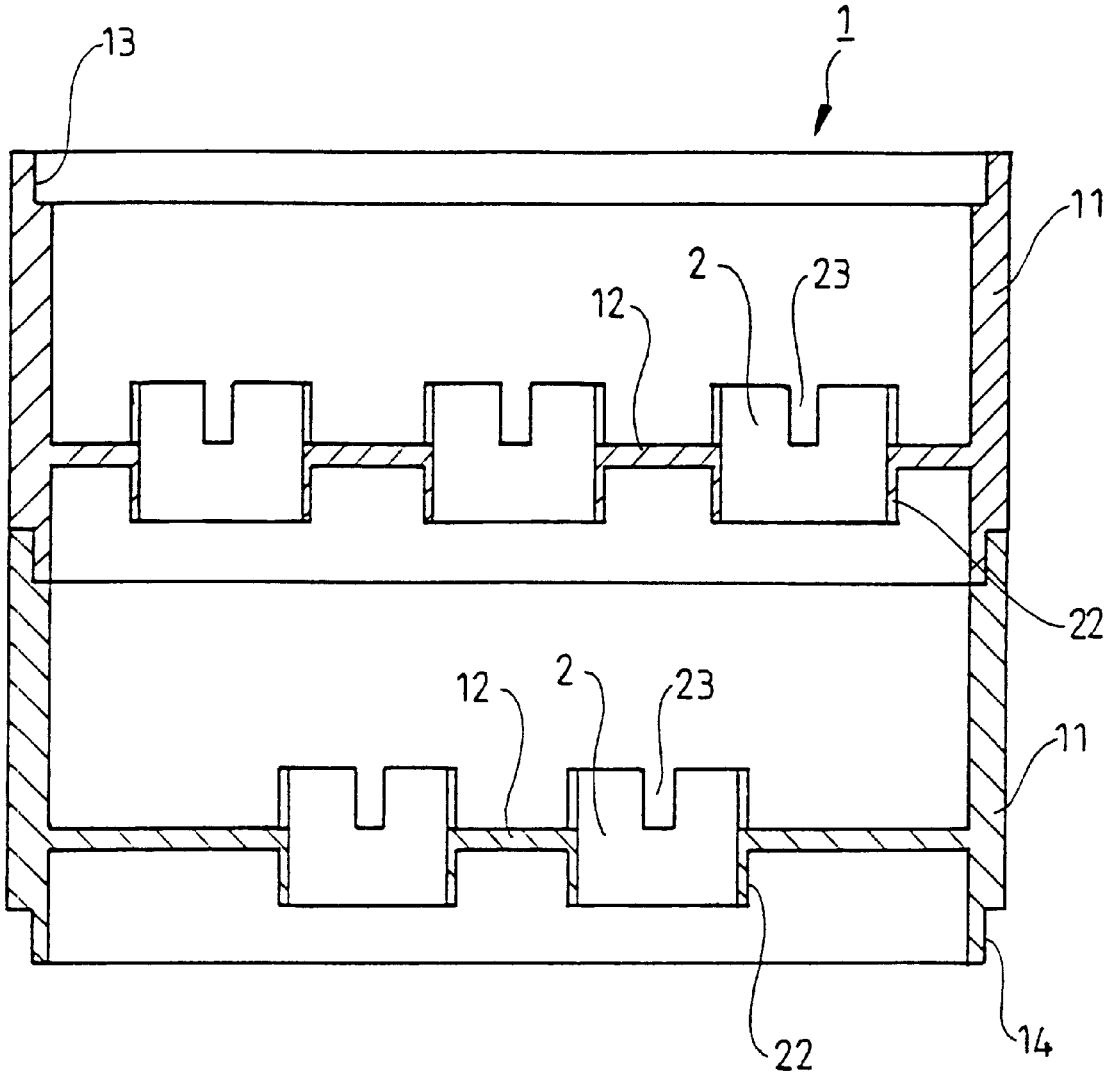
FIG. 4 is a sectional view taken along line 4—4 in FIG. 3.

As shown in FIG. 2, a periphery that defines each atomizing hole 2 includes an annular upper wall 21 extending upwardly therefrom and an annular lower wall 22 extending downwardly therefrom, the annular upper wall 21 including a number of notches 23 defined therein. Each notch 23 has a lower edge that is flush with or slightly higher than the board 12 (FIG. 4) so as to allow liquid to flow through the notches 23 into the holes 2 of an upper atomizing board 1 and thus enters the lower atomizing board 1. The atomizing holes 2 are arranged in the board 12 in a manner that they are asymmetrical to a central transverse axis 15 that is perpendicular to a longitudinal axis (not labeled) of the board 12. As a result, when superimposing one atomizing board 1 onto another atomizing board 1, the lower one (or the upper one) is rotated through 180° or turned upside-down, such that each atomizing hole 2 on the upper atomizing board 1 is partially aligned (not completely aligned) with one or two atomizing holes 2 of the lower atomizing board 1, best shown in FIG. 3. Accordingly, liquid may flow through stacked atomizing boards in accordance with the present invention and thus atomize when the liquid passes through partially aligned atomizing holes 2.

Figure 5:
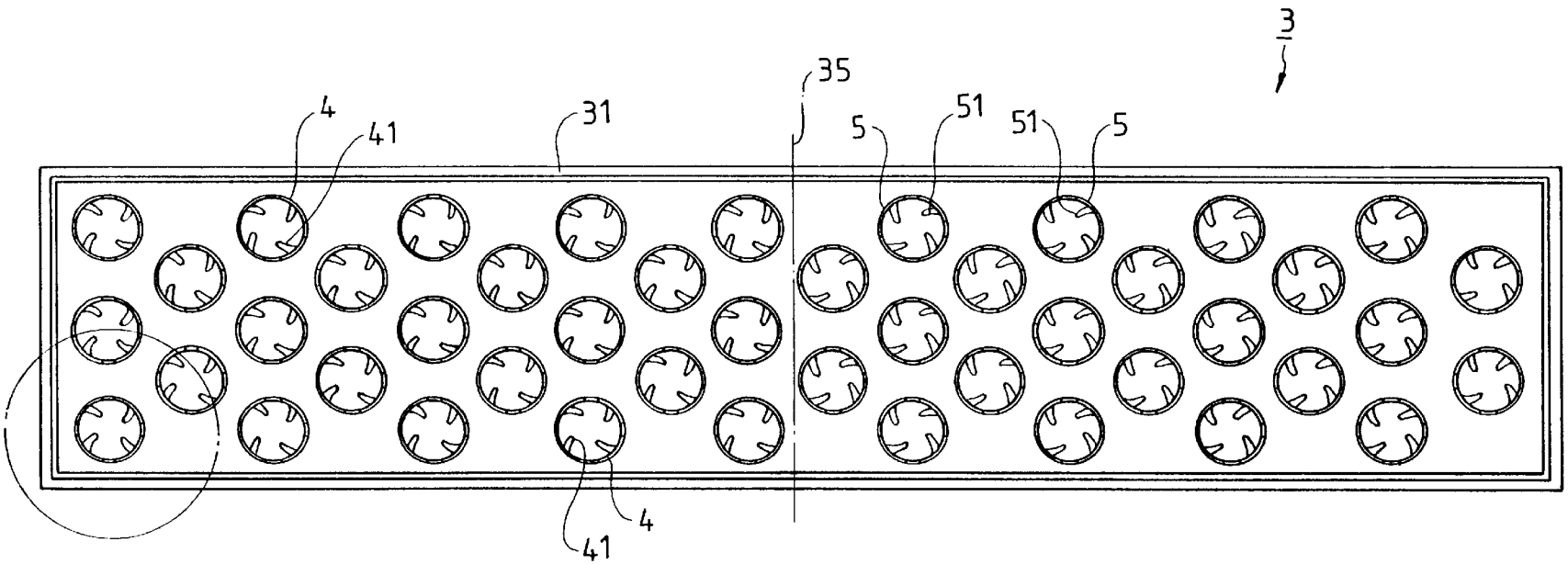
FIG. 5 is a top view of a second embodiment of the atomizing board in accordance with the present invention.
Figure 6:
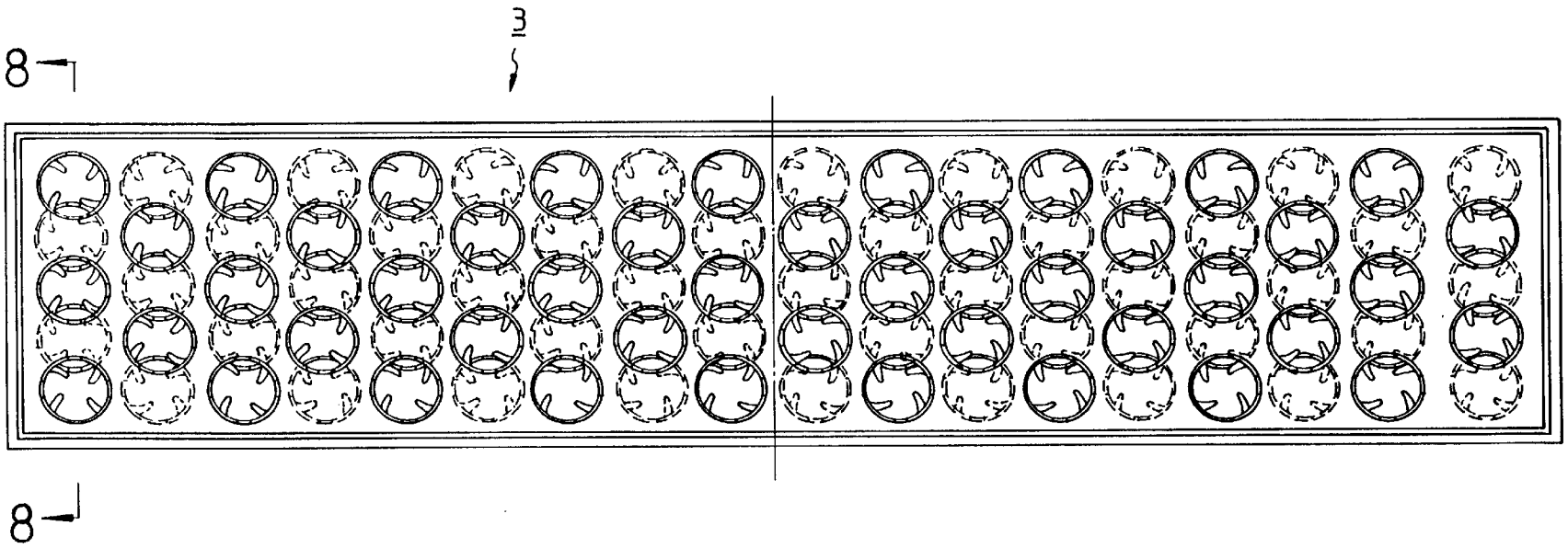
FIG. 6 is a top view of two stacked atomizing boards in accordance with the present invention.
Figure 7:
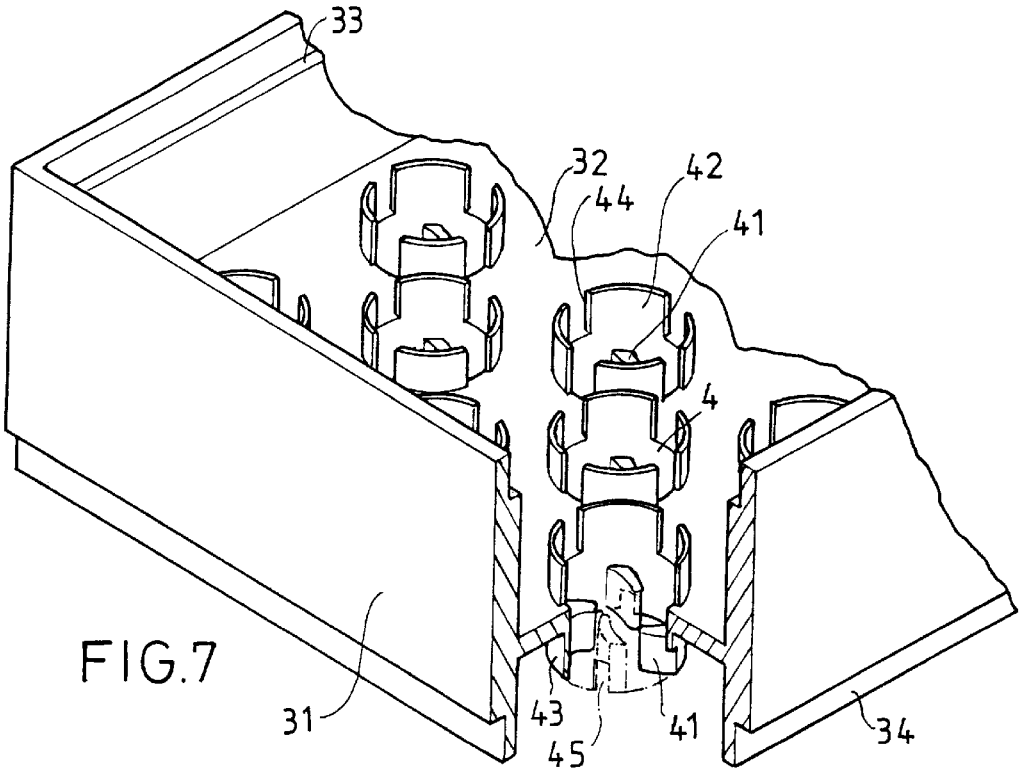
FIG. 7 is a partial perspective view illustrating detailed structure of a circle in FIG. 5.

FIG. 5 illustrates a second embodiment of the atomizing board 3 in accordance with the present invention. The atomizing board 3 is preferably polygonal (e.g., rectangular) and includes a board 32 surrounded by a peripheral wall 31 and a plurality of clockwise atomizing holes 4 and a plurality of counterclockwise atomizing holes 5 defined in the board 32. The peripheral frame 31 includes a peripheral ledge 33 formed on an upper part thereof and a recessed peripheral section 34 to allow stacking of two atomizing boards 3 (FIG. 7).

Figure 8:
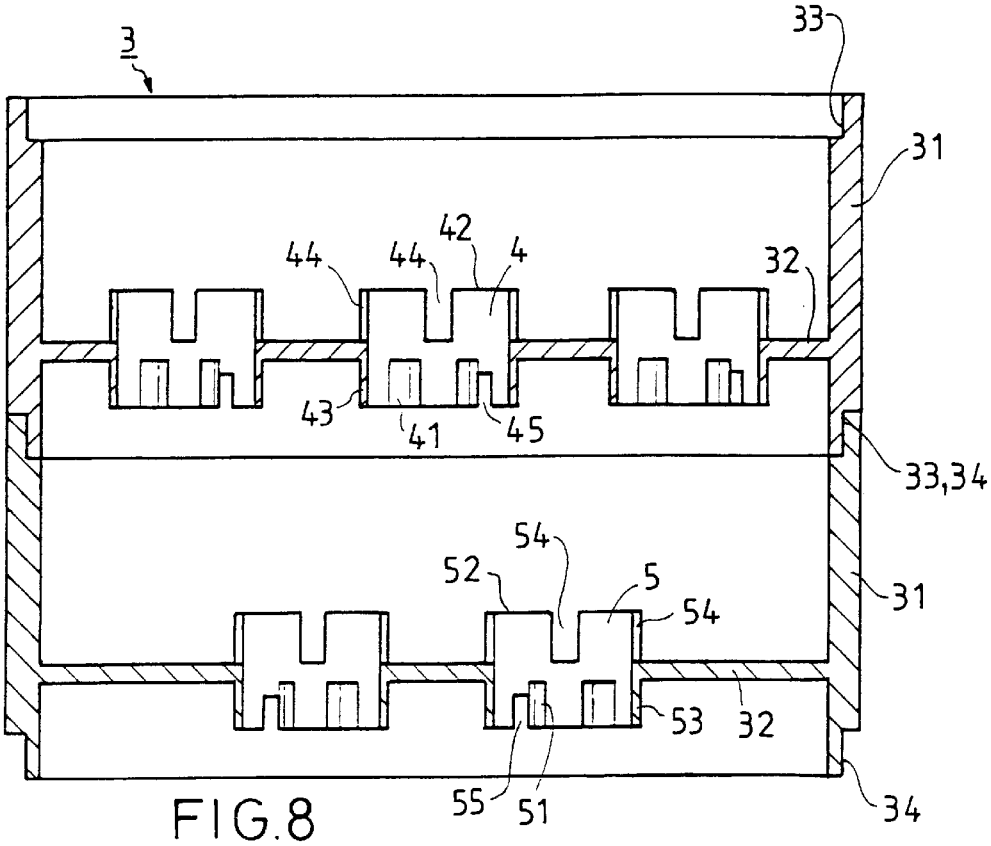
FIG. 8 is a sectional view taken along line 8—8 in FIG. 6.

As shown in FIG. 5, each clockwise atomizing hole 4 includes a number of clockwise oriented blades 41 provided therein, while each counterclockwise atomizing hole 5 includes a number of counterclockwise oriented blades 51 provided therein. In addition, as shown in FIGS. 7 and 8, a periphery that defines each atomizing hole 4, 5 includes an annular upper wall 42, 52 extended upwardly therefrom and an annular lower wall 43, 53 extended downwardly therefrom. The annular upper wall 42, 52 includes a number of notches 44, 54 defined therein. Each notch 44, 54 has a lower edge that is flush with or slightly higher than the board 32 (FIG. 8). Furthermore, the annular lower wall 43, 53 includes a number of gas inlets 45, 55. Each air inlet 45, 55 is located adjacent to a root of a relatively longer arcuate portion of an associated blade 41, 51.

The clockwise atomizing holes 4 and counterclockwise atomizing holes 5 are arranged on both sides of a central transverse axis 35 (FIG. 5), respectively. Thus, when superimposing one atomizing board 3 onto another atomizing board 3, the lower one (or the upper one) is rotated through 180° or turned upside-down, such that each atomizing hole 4, 5 on the upper atomizing board 1 is partially aligned (not completely aligned) with one or two atomizing holes 4, 5 of the lower atomizing board 3, best shown in FIG. 8. In an embodiment of the invention, as shown in FIG. 8, the lower atomizing board 3 is rotated through 180° such that each atomizing hole 4 with clockwise oriented blades 41 on the upper atomizing board 3 partially aligns with one or two atomizing holes 5 with counterclockwise oriented blades 51 on the lower atomizing board 3. Thus, when gas (e.g., air) flows from a lower atomizing board 3 upward to an upper atomizing board 3, the gas passes through the holes 4 and 5 and impinges the blades 41 and 51 and thus generates turbulence to further improve the atomizing effect of liquid that flows downwardly from the holes 4 of the upper atomizing board 3 to the holes 5 of the lower atomizing board 3.

According to the above description, it is appreciated that the atomizing boards of the present invention can be stacked to a desired level in which the upper atomizing board and the lower atomizing board are disposed in different orientation, namely, the upper one or the lower one can be turned through 180° or turn upside-down such that the atomizing holes of the upper atomizing board is only partially aligned with at least one of the atomizing holes of the lower atomizing board, rather than completely aligned with an atomizing hole of the lower atomizing board. In addition, liquid that flows from the uppermost atomizing board falls into the atomizing boards therebelow via the cutouts 23, 44, and 54. Whilst the gas that flows upwardly from the lowermost atomizing board 3 enters the atomizing holes 4, 5 via the gas inlets 45, 55 and thus generates turbulence due to provision of the clockwise oriented blades 41 and the counterclockwise oriented blades 51 to improve the atomizing effect of the liquid.

Although the invention has been explained in relation to its preferred embodiment, it is to be understood that many other possible modifications and variations can be made without departing from the spirit and scope of the invention as hereinafter claimed.

What is claimed is:

1. An atomizing board comprising:

a board surrounded by a peripheral frame, the peripheral frame being configured to allow stacking of two said atomizing boards, the board including a plurality of atomizing holes defined therein, a periphery that defines each said atomizing hole including an annular upper wall extending upwardly therefrom and an annular lower wall extending downwardly therefrom, the annular upper wall including a plurality of notches defined therein, the atomizing holes being arranged in the board in a manner that they are asymmetrical to a central transverse axis of the board such that in two stacked atomizing boards consisting of an upper said atomizing board and a lower said atomizing board, one of the lower atomizing board and the upper atomizing board is in a status that is rotated through 180° or turned upside-down relative to the other of the lower atomizing board and the upper atomizing board, and each said atomizing hole on the upper atomizing board is partially aligned with at least one of said atomizing holes of the lower atomizing board.

2. The atomizing board as claimed in claim 1, wherein each said notch has a lower edge that is flush with the board.

3. The atomizing board as claimed in claim 1, wherein each said notch has a lower edge that is slightly higher than the board.

4. An atomizing board comprising:

a board surrounded by a peripheral frame, the peripheral frame being configured to allow stacking of two said atomizing boards, the board including a plurality of clockwise atomizing holes and a plurality of counterclockwise atomizing holes defined therein, each said clockwise atomizing hole including a plurality of clockwise oriented blades therein, each said counterclockwise atomizing hole including a plurality of counterclockwise oriented blades therein, a periphery that defines each of said clockwise atomizing holes and said counterclockwise atomizing holes including an annular upper wall extending upwardly therefrom and an annular lower wall extending downwardly therefrom, the annular upper wall including a plurality of notches defined therein, the clockwise atomizing holes and the counterclockwise atomizing holes being arranged on both sides of a central transverse axis of the board, respectively, such that in two stacked atomizing boards consisting of an upper said atomizing board and a lower said atomizing board, one of the lower atomizing board and the upper atomizing board is in a status that is rotated through 180° relative to the other of the lower atomizing board and the upper atomizing board, each said clockwise atomizing hole on the upper atomizing board is partially aligned with at least one of said counterclockwise atomizing holes of the lower atomizing board, and each said counterclockwise atomizing hole on the upper atomizing board is partially aligned with at least one of said clockwise atomizing holes of the lower atomizing board.

5. The atomizing board as claimed in claim 4, wherein the annular lower wall of each of the clockwise atomizing holes and the counterclockwise atomizing holes includes a plurality of gas inlets, each of said clockwise oriented blades and said counterclockwise oriented blades including a relatively longer arcuate portion having a root, and each said gas inlet being located adjacent to the root of the arcuate portion of an associated said one of said clockwise oriented blades and said counterclockwise oriented blades.

6. The atomizing board as claimed in claim 4, wherein each said notch has a lower edge that is flush with the board.

7. The atomizing board as claimed in claim 4, wherein each said notch has a lower edge that is slightly higher than the board.

* * * * *